United States Patent [19]

McChesney et al.

[11] 4,315,889

[45] Feb. 16, 1982

[54] METHOD OF REDUCING LEACHING OF COBALT FROM METAL WORKING TOOLS CONTAINING TUNGSTEN CARBIDE PARTICLES BONDED BY COBALT

[75] Inventors: John M. McChesney, Huntington, W. Va.; Perry E. Landers, Russell, Ky.

[73] Assignee: Ashland Oil, Inc., Ashland, Ky.

[21] Appl. No.: 106,500

[22] Filed: Dec. 26, 1979

[51] Int. Cl.[3] ..... C23F 11/14; C23F 11/16; C10M 1/06

[52] U.S. Cl. ..... 422/7; 252/34; 252/47; 252/49.3; 252/49.5; 252/50; 252/390; 252/391; 252/392

[58] Field of Search ..... 252/34, 47, 49.3, 49.5, 252/50, 390, 391, 392; 422/7, 16

[56] References Cited

U.S. PATENT DOCUMENTS

| | | | |
|---|---|---|---|
| 3,507,792 | 4/1970 | Zuraw | 252/49.5 |
| 3,537,999 | 11/1970 | Kennedy | 252/47 X |
| 3,833,502 | 9/1974 | Leary et al. | 252/49.5 |
| 4,178,253 | 12/1979 | Lee et al. | 252/47 |

FOREIGN PATENT DOCUMENTS

| | | | |
|---|---|---|---|
| 1444903 | 11/1968 | Fed. Rep. of Germany | 252/49.3 |

OTHER PUBLICATIONS

Application Data Sheet "Copper·Brass·Bronze Benzotriazole: An Effective Corrosion Inhibitor for Copper Alloys".

R. T. Vanderbilt Co. Inc.-Vanlube 793, OD-7810-X, Vanchem-DMTD, Vanchem Natd.

Benzotriazole, Tolyltriazole-Technical Bulletin 143-Sherwin Williams Chemicals.

Cobratec-Sherwin-Williams Co.-1976.

"The Condensed Chemical Dictionary" -Ninth Edition, pp. 792 "Sodium Gluconate"-1977.

"Chelating Agents"-Metal Industry-Finishing Supplement-Apr. 1958.

*Primary Examiner*—Andrew Metz

*Attorney, Agent, or Firm*—Pollock, Vande Sande & Priddy

[57] ABSTRACT

Metal-working compositions (water-base, oil-base and oil-in-water emulsions) containing triazole and thiadiazole compounds are disclosed. These compositions prolong the working life of metal cutting and grinding tools containing tungsten carbide particles bonded together by nickel or cobalt. The oil-base coolant and lubricant comprises a mineral oil, a triazole or thiadiazole compound, and optionally, an extreme pressure lubricant, fats, rust preventives and mist suppressants. The aqueous base and oil-in-water emulsion metal-working compositions are prepared in the form of a liquid concentrate which subsequently is diluted with water to form the metal-working coolant or lubricant. The concentrate to be diluted and made into an aqueous coolant and lubricant comprises a triazole and thiadiazole compound, boric acid, an amine or mixture of amines, sodium gluconate and an aromatic or paraffinic carboxylic acid. Optionally a wetting agent, bactericide, fungicide, extreme pressure agent and an antifoaming agent can also be added to the formulation. The concentrate to be diluted to form an oil-in-water emulsion lubricant and coolant comprises mineral oil, a triazole or thiadiazole and emulsifiers. Optionally, there may also be added bactericides, extreme pressure agents and antifoaming agents.

12 Claims, No Drawings

METHOD OF REDUCING LEACHING OF COBALT FROM METAL WORKING TOOLS CONTAINING TUNGSTEN CARBIDE PARTICLES BONDED BY COBALT

NATURE OF THE INVENTION

This invention relates to corrosion inhibitors for cobalt and nickel in the metallic form. More specifically this invention relates to water-base, oil-base, and oil-in-water emulsion lubricant and coolant compositions, used in the drilling, cutting and milling and other metal working operations.

BACKGROUND OF THE INVENTION

A large percentage of industrial cutting tools used to drill, cut, grind, and mill metals are made of tungsten carbide particles held together by a cobalt bonding agent. In a few instances the bonding agent may be nickel or platinum. The drilling, cutting, milling, or other metal working step requires the application of a liquid coolant or lubricant at the area of contact between the metal surface being machined and the drilling, cutting or milling tool. Although water or mineral oil can be used alone as a coolant or lubricant the practice has been to add compounds which increase the lubricity and cooling ability of the liquid and which delay its deterioration. These added compounds often, however, contain sequestering (chelating) agents and moities such as sulfur, chlorine, carboxyl groups and hydroxyl ions. It has been observed that when cutting, drilling or milling tools which are made up of tungsten carbide particles bonded with cobalt or nickel metal are exposed to these cutting fluids containing chelating agents or moities such as sulfur, chlorine, carboxyl groups and hydroxyl ions, the cobalt or nickel is leached away. Leaching of the cobalt or nickel metrix from the tool leaves a residue of carbide particles and results in premature failure of the tool. The presence of sequesterants or moities in the coolant or lubricant, as well as the mere presence of hydrogen and hydroxyl ions in a water-base cutting fluid, are thought to be responsible for the leaching of cobalt (or nickel). An object of this invention, therefore, is to reduce the corrosion of cobalt and nickel surfaces. Another object of this invention is to prevent or reduce the rate of leaching of cobalt and nickel binder from machining tools made up of abrasive particles such as tungsten carbide and a binder material such as cobalt or nickel.

Another object of this invention is to prevent or reduce the corrosion or oxidation of aluminum alloys during the said machining action when water-base coolants and lubricants are used.

SUMMARY OF THE INVENTION

Briefly stated this invention comprises contacting with a solution of a triazole or thiadiazole compound a cobalt or nickel surface exposed to leaching action by a liquid agent. Ordinarily the triazole or thiadiazole compound will be contained in the liquid leaching agent. In another aspect this invention comprises a concentrate for preparing an aqueous base, oil base or oil-in-water emulsion lubricant and coolant composition containing therein a triazole or thiadiazole or mixtures thereof. In still another aspect this invention comprises the coolant and lubricant composition made by diluting the concentrate with oil or water. In still another aspect this invention comprises the method of drilling, grinding, cutting or otherwise working a metal utilizing the coolant and lubricant composition described above. The utility of the water-base concentrate and water-base coolant composition is further enhanced by the addition of 1 to 4 parts of sodium gluconate. Specifically when aluminum is being machined the sodium gluconate prevents corrosion.

DETAILED DESCRIPTION OF THE INVENTION

The triazole compounds utilized in this invention have the generic formula:

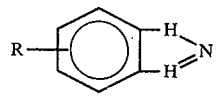

where R is hydrogen or a methyl substituent. If R is hydrogen the compound is benzene triazole and if R is a methyl radical then the compound is tolyl triazole.

The thiadiazole compounds utilized in this invention can have the generic formula:

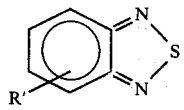

where R' is a hydrogen or a methyl substituent. When R' is hydrogen then the compound is 2,1,3-benzothiadiazole. Other thiadiazole compounds which can be utilized are 2,5-dimercapto-1,3,4-thiadiazole having the structural formula:

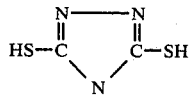

the disodium salt thereof, disodium 2,5-dimercaptothiadiazole having the formula:

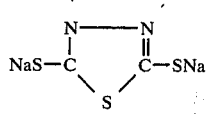

and di-(triethanolammonium) dimercaptothiadiazole.

In the following description all compositions are described in parts by weight unless specified otherwise.

OIL BASE LIQUID COOLANT AND LUBRICANT COMPOSITION

The oil-base working-composition comprises between 80 and 95 parts of mineral oil; and between 1 and 5 parts of one of the triazole or dithiazole compounds shown above or mixtures thereof. Optionally other additives can be added such as between 1 and 10 parts of an extreme pressure lubricant, between 1 and 5 parts of rust preventive and between 1 and 5 parts of mist suppressant. These additives are known to those skilled in the art and are readily available in commerce. In the oil-base lubricant composition made therefrom the preferred triazole compound is benzyltriazole and the preferred thiadiazole compound is 2,1,3-benzothiadiazole.

A suitable extreme pressure lubricant is Klora 6001 manufactured by Kiel Chemical. A suitable rust preventive is Tectyl 477 manufactured by Valvoline International and a suitable mist suppressant is manufactured by Exxon Corporation. When these optional compounds are added, the triazole and thiadiazole compounds are most effective since the introduction of these materials also bring into the lubricant composition those agents thought to be responsible for the leaching of cobalt and nickel from cutting and grinding tools.

OIL-IN-WATER EMULSION CONCENTRATE AND COOLANT AND LUBRICANT COMPOSITIONS

The concentrate which is to be subsequently diluted with water to form an oil-in-water emulsion coolant and lubricant comprises between 60 and 80 parts of mineral oil; between 1 and 5 parts of one of the triazole or thiadiazole compounds above or mixtures thereof; and between 15 and 25 parts of an emulsifier. Optionally there may also be added between 1 and 2 parts of a bactericide, between 3 and 10 parts of an extreme pressure lubricant and between 1 and 3 parts of an antifoaming agent. The lubricant and coolant composition is prepared by diluting the above-described composition with water until the concentration of triazole or thiadiazole is between about 250 and about 2000 parts per million. For these oil-in-water emulsion compounds the preferred triazole is benzyltriazole and the preferred thiadiazole is 2,5-dimercapto-1,3,4-thiadiazole.

A suitable emulsifier is sodium sulfate, a suitable bactericide is Bioban P 1487; a suitable extreme pressure lubricant is Kloro 6001 and a suitable antifoaming agent is Nopco NDW available from Diamond Shamrock Corporation.

WATER-BASE CONCENTRATES AND WATER-BASE COOLANT AND LUBRICANT COMPOSITIONS

The concentrate which is to be subsequently diluted with water to form a water-base coolant and lubricant comprises between 60 and 80 parts of water; between 3 and 10 parts of a triazole or thiadiazole or mixtures thereof; between 2 and 8 parts of an aromatic or paraffinic carboxylic acid; between 2 and 10 parts of boric acid; and between 5 and 20 parts of an amine or mixture of amines that will react with the carboxylic acid component of the composition. Optionally there may be added between 0.1 and 5 parts of a wetting agent; between 1 and 2 parts of a bactericide and fungicide; and between 1 and 2 parts of an antifoaming agent. The triazole and thiadiazole compounds are particularly effective against the leaching of cobalt and nickel when these optional additives are included since they bring into the system those moities which contribute to leaching. In this water-base concentrate and the water-base lubricant made by adding water to the concentrate the preferred triazole compound is tolyltriazole and the preferred dithiazole compound is the sodium salt of 2,5-dimercaptothiadiazole.

The aromatic or paraffinic carboxylic acid can be any of the following:

An alkylsulfuramido carboxylic acid having the formula:

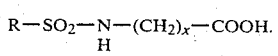

$$R-SO_2-\underset{H}{N}-(CH_2)_x-COOH. \quad \text{I}$$

An arylsulfuramido carboxylic acid having the formula:

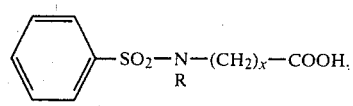

$$\text{II}$$

An acyclic carboxylic acid having the formula:

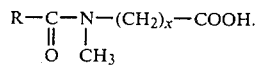

$$R-\underset{\underset{O}{\|}}{C}-\underset{\underset{CH_3}{|}}{N}-(CH_2)_x-COOH. \quad \text{III}$$

IV. A fatty acid sarcoside having the formula:

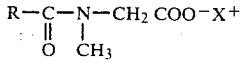

$$R-\underset{\underset{O}{\|}}{C}-\underset{\underset{CH_3}{|}}{N}-CH_2\,COO^-X^+$$

V. An alkenyl dicarboxylic acid having the formula:

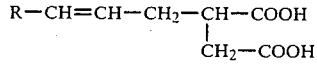

$$R-CH=CH-CH_2-\underset{\underset{CH_2-COOH}{|}}{CH}-COOH$$

An alkylphenyl carboxylic acid having the formula:

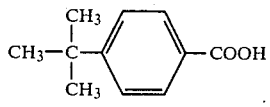

VII. or mixture of these where R is hydrogen or an alkyl group, and the subsript X is at least 14.

The amine component can be any secondary or tertiary amine of sufficient reactivity to react with the boric acid and organic carboxylic acid components. Suitable amines include di- or triethanolamine or triisopropanol amine; and 2-dimethylamino, 2-methyl, 1-propanol amine. The carboxylic acid can be arylsulfonamidocarboxylic acid.

The wetting agent can be any wetting agent compatible with the remainder of the system. It should be low foaming and totally water soluble. Suitable wetting agents are Pluronic L-43 available from the BASF Wyandotte Corporation, and Niaproof 08 from Niacet Chemical Company.

As indicated previously, compatible germicides (fungicides and bactericides) optionally can also be included in amounts up to 6 parts per 100 parts of additive. A suitable fungicide and a bactericide are Grotan and Bioban, available from the Lehn and Fink Co., Inc., and IMC Chemicals Group, Inc., respectively.

The antifoaming agent is added in an amount up to 1 part per 100 parts by weight of additive. A suitable antifoaming agent is SAG 30 available from Union Carbide Corporation.

The remainder of the additive (concentrate) is made up with water added to bring the total weight of the additive up to 100 parts by weight.

To formulate an aqueous grinding or cutting fluid composition, the above-described additive (concentrate) is diluted with additional water in an amount of between 2 and 15 parts of additive per 100 parts of water. The resulting cutting fluid composition is applied to the metal surface being worked such as by machining, milling or cutting in the conventional manner.

When aluminum metal is machined using an aqueous base coolant containing sodium gluconate the machined surface is less susceptible to corrosion. The utility of the water-base concentrate and water-base coolant and lubricant compositions is further enhanced by the addition of between about 1 and 4 parts of sodium gluconate.

EXAMPLE 1

OIL BASE COOLANT AND LUBRICANT

An oil-base coolant and lubricant was prepared by mixing the following components:

| | Parts by Weight |
|---|---|
| Mineral oil | 81 |
| 2,1,3-benzothiadiazole | 3 |
| Extreme pressure additive (mixture of chlorimated paraffins and sulfurized fats) | 10 |
| Rust preventative (Tectyl 477, Ashland Oil, Inc.) | 3 |
| Mist suppressant | 3 |

EXAMPLE 2

OIL-IN-WATER-EMULSION CONCENTRATE AND COOLANT AND LUBRICANT COMPOSITION

A concentrate was prepared by mixing the following components:

| | Parts by Weight |
|---|---|
| Sodium sulfonate | 18 |
| Oleic acid | 1 |
| Triethanol amine | 1 |
| Bactericide (IMC Chemicals Group, Inc.) | 1 |
| Antifoaming agent (Napco NDW, Diamond Shamrock, Inc.) | 1 |
| Extreme pressure agent (chlorinated paraffins) | 10 |
| Tolyltriazole | 3 |
| Mineral Oil | 65 |
| | 100 |

This concentrate was then used to prepare a metal-working coolant and lubricant by diluting it in a ratio of 3 parts by weight of concentrate to 97 parts of water.

EXAMPLE 3

WATER-BASE CONCENTRATE AND COOLANT AND LUBRICANT COMPOSITION

A concentrate was prepared by mixing the following components:

| | Parts by Weight |
|---|---|
| Boric acid | 6 |
| Diethanol amine | 12 |
| Arylsulfonamidocarboxylic acid (Hostacar H Liquid)* | 4 |
| Bactericide (IMC Chemicals Group, Inc.) | 1 |
| Antifoaming agent (Napco NDW Diamond Shamrock, Inc.) | 1 |
| Sodium gluconate | 2 |
| Tolyltriazole | 5 |
| Polyglycol (lubricating additive)** | 5 |
| Water | 64 |
| Total | 100 |

*Product of American Hoechst Corporation, having a specific gravity of 1.17 + 0.05, solidification point of −16° C. and acid number of 161 + 10.
**This component is optional but its use increases lubricity.

This concentrate was diluted in a ratio of 3 parts of concentrate to 97 parts of water to form a water-base metal working coolant and lubricant.

Tests of metal-working coolant and lubricant compositions in each of the preceding examples were conducted. The resistance of specimens of tungsten carbide particles bonded together with cobalt to leaching by the liquid coolants and lubricants was observed to be substantially reduced.

Applicants in the preceding description of their invention have disclosed what they believe to be the best mode of utilizing their invention. The metal working coolants and lubricants are compatible with ferrous and non-ferrous metals including the yellow metal alloys such as brass and copper. The water-base compositions are markedly effective in minimizing the corrosion of aluminum.

We claim:

1. A method for reducing the leaching of cobalt from a surface through exposure of said surface to agents capable of leaching cobalt, comprising contacting a surface containing cobalt with a liquid composition containing a compound selected from the group consisting of triazole compounds having the structural formula:

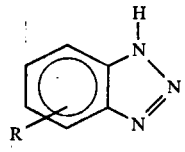

wherein R is a hydrogen or a methyl radical;
thiadiazole compounds having the structural formula:

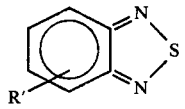

wherein R′ is hydrogen or a methyl radical;
thiadiazole compounds having the structural formula:

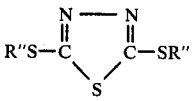

wherein R″ is hydrogen or sodium;

di-(triethanolammonium) dimercapto-thiadiazole; and mixtures thereof wherein said compound is present in an amount effective to reduce the leaching of cobalt.

2. The method of claim 1 wherein said surface containing said metal is made of tungsten carbide particles bonded by cobalt.

3. The method of claim 1 wherein the concentration of said compound in said liquid composition is between about 1 and about 5 parts per 100 by weight.

4. The method of claim 1, wherein said compound is tolyltriazole.

5. The method of claim 1, wherein said compound is 2,1,3-benzothiadiazole.

6. The method of claim 1 wherein said liquid composition comprises about 80 to about 95 parts by weight of mineral oil and about 1 to about 5 parts by weight of said compound.

7. The method of claim 6 wherein said composition also contains at least one of 1 to 10 parts by weight of an extreme pressure lubricant, 1 to 5 parts by weight of rust preventative or 1 to 5 parts by weight of a mist suppressant.

8. The method of claim 2 or 3 wherein said composition also contains at least one of 1 to 10 parts by weight of an extreme pressure lubricant, 1 to 5 parts by weight of rust preventative or 1 to 5 parts by weight of a mist suppressant.

9. The method of claim 1 wherein said liquid composition is an oil-in-water emulsion which comprises an oil-in-water concentrate comprising 60 to 80 parts by weight of mineral oil, 1 to 5 parts by weight of said compound, 15 to 25 parts by weight of an emulsifier; and a sufficient amount of water to provide about 250 to about 2000 parts per million of said compound in said emulsion.

10. The method of claim 9 wherein said concentrate also contains at leat one of 1–2 parts by weight of bactericide, 3–10 parts of an extreme pressure lubricant and 1–3 parts of an antifoaming agent.

11. The method of claim 9 or 10 wherein said emulsifier includes sodium sulfate.

12. The method of claim 1 wherein said liquid composition is a water base composition.

* * * * *